US007175297B2

(12) United States Patent
Hagen

(10) Patent No.: US 7,175,297 B2
(45) Date of Patent: Feb. 13, 2007

(54) IN-GRADE LIGHT FIXTURE WITH LEVELING AND ALIGNMENT MECHANISMS, INSTALLATION FEATURES AND ANTI-CONDENSATION VALVE

(75) Inventor: Douglas W. Hagen, Coarsegold, CA (US)

(73) Assignee: B-K Lighting, Inc., Madera, CA (US)

( * ) Notice: Subject to any disclaimer, the term of this patent is extended or adjusted under 35 U.S.C. 154(b) by 178 days.

(21) Appl. No.: 10/799,393

(22) Filed: Mar. 12, 2004

(65) Prior Publication Data

US 2004/0246709 A1 Dec. 9, 2004

Related U.S. Application Data

(60) Provisional application No. 60/454,506, filed on Mar. 13, 2003.

(51) Int. Cl.
*E01F 9/00* (2006.01)

(52) U.S. Cl. ..... 362/153.1; 362/285; 362/294; 362/364

(58) Field of Classification Search ..... 362/153, 362/153.1, 386, 364, 365, 285, 294
See application file for complete search history.

(56) References Cited

U.S. PATENT DOCUMENTS

| | | | | |
|---|---|---|---|---|
| 1,240,452 A | | 9/1917 | Hotchkin | 103/86 |
| 1,853,321 A | * | 4/1932 | Rogers | 340/953 |
| 2,806,080 A | | 9/1957 | Corey | 346/636 |
| 3,192,379 A | | 6/1965 | De Garmo | 201/972 |
| 3,339,066 A | | 8/1967 | Hart | 500/710 |
| 3,463,913 A | * | 8/1969 | Shavalier | 362/372 |
| 3,635,808 A | | 1/1972 | Elevitch | 204/180 G |
| 3,770,878 A | | 11/1973 | Dorier | 174/153 R |

(Continued)

FOREIGN PATENT DOCUMENTS

DE 3635808 5/1988

OTHER PUBLICATIONS

Think PEI-Genesis For Military And Industrial Connectors. 2001 *PEI-Genesis*. Apr. 28, 2002 http://www.pei-genesis.com/

(Continued)

*Primary Examiner*—Renee Luebke
*Assistant Examiner*—Gunyoung T. Lee
(74) *Attorney, Agent, or Firm*—Koppel, Patrick, Heybl & Dawson

(57) ABSTRACT

An in-grade light fixture, comprising a below grade light fixture having a light opening substantially at grade level. An optical chamber is arranged within the light fixture housing and holding a light source generating light that passes through the light opening. A faceplate mechanism mounted over the light opening and to the optical chamber, and is held in place by mounting screws. The faceplate mechanism is at least partially rotatable over the light opening so that the location of said mounting screws can be adjusted around the light opening. An adjustment mechanism is included to adjust the height and angle of the faceplate mechanism to match the height and angle of the surrounding grade level and angle. A holding mechanism can also be included for holding the light fixture housing at the desired height within a hole prior to being buried. An anti-condensation valve can also be included on the optical chamber.

17 Claims, 4 Drawing Sheets

U.S. PATENT DOCUMENTS

| | | | | |
|---|---|---|---|---|
| 3,845,435 | A | 10/1974 | Georgopulos | 336/65 |
| 3,869,563 | A | 3/1975 | Ocken, Jr. | 174/52 PE |
| 3,949,213 | A | 4/1976 | Paitchell | 240/26 |
| 4,000,406 | A | 12/1976 | Bhavsar | 240/11.2 R |
| 4,131,331 | A | 12/1978 | Kendall, Jr. | 339/126 RS |
| 4,143,508 | A | 3/1979 | Ohno | 58/23 R |
| 4,343,033 | A | 8/1982 | Suzuki | 362/307 |
| 4,344,118 | A | 8/1982 | Rundquist et al. | 362/267 |
| 4,430,944 | A | 2/1984 | Theurer | 104/7 R |
| 4,433,366 | A | 2/1984 | Wade | 362/267 |
| 4,460,944 | A | 7/1984 | Gordbegli et al. | 362/276 |
| 4,539,629 | A | 9/1985 | Poppenheimer | 362/267 |
| 4,574,337 | A | 3/1986 | Poppenheimer | 362/267 |
| 4,617,616 | A | 10/1986 | Juell et al. | 362/267 |
| 4,674,187 | A | 6/1987 | Poppenheimer | 30/360 |
| 4,694,119 | A | 9/1987 | Groenewegen | 174/52 PE |
| 4,695,930 | A | 9/1987 | Wierzbicki et al. | 362/293 |
| 4,768,139 | A | 8/1988 | Poppenheimer | 362/302 |
| 4,924,364 | A * | 5/1990 | Pannier | 362/153.1 |
| 4,931,915 | A | 6/1990 | Quiogue | 362/267 |
| 4,956,561 | A | 9/1990 | Tamer | 307/10.1 |
| 4,996,635 | A * | 2/1991 | Olsson et al. | 362/477 |
| 4,999,757 | A | 3/1991 | Poppenheimer | 362/287 |
| 5,011,950 | A | 4/1991 | Fukuoka et al. | 549/336 |
| 5,041,950 | A | 8/1991 | Tyson | 362/96 |
| 5,050,052 | A | 9/1991 | Wade | 362/101 |
| 5,195,962 | A | 3/1993 | Martin et al. | 604/43 |
| 5,198,962 | A | 3/1993 | Tyson | 361/380 |
| 5,207,499 | A | 5/1993 | Vajda et al. | 362/96 |
| 5,276,583 | A | 1/1994 | Tyson | 361/679 |
| RE34,709 | E | 8/1994 | Tyson | 362/96 |
| 5,349,505 | A | 9/1994 | Poppenheimer | 362/101 |
| 5,408,397 | A | 4/1995 | Tyson | 362/267 |
| 5,450,300 | A * | 9/1995 | Rector, Jr. | 362/153.1 |
| 5,481,443 | A | 1/1996 | Wagner et al. | 362/153.1 |
| 5,483,428 | A | 1/1996 | Poppenheimer | 362/101 |
| 5,486,988 | A | 1/1996 | Tyson | 362/267 |
| 5,556,188 | A | 9/1996 | Poppenheimer | 362/101 |
| 5,727,873 | A | 3/1998 | Tyson | 362/294 |
| 5,743,622 | A | 4/1998 | Ibbitson et al. | 362/153.1 |
| 5,779,349 | A * | 7/1998 | Reinert, Sr. | 362/153.1 |
| 5,842,771 | A | 12/1998 | Thrasher et al. | 362/101 |
| 5,887,966 | A | 3/1999 | Eissner et al. | 362/153.1 |
| 5,908,236 | A | 6/1999 | Lueken et al. | 362/364 |
| 6,168,290 | B1 * | 1/2001 | Christiansen | 362/253 |
| 6,254,258 | B1 * | 7/2001 | Case | 362/373 |
| D461,267 | S | 8/2002 | Arumugasaamy | D26/85 |
| 6,481,867 | B2 | 11/2002 | Ewing | 362/226 |
| D467,676 | S | 12/2002 | Packer et al. | D26/72 |
| D467,677 | S | 12/2002 | Ries et al. | D26/88 |
| D468,046 | S | 12/2002 | Bernard et al. | D26/85 |
| D468,049 | S | 12/2002 | Ries et al. | D26/89 |
| 6,499,227 | B1 | 12/2002 | Jacobson | 34/106 |
| 6,499,866 | B1 | 12/2002 | Logan et al. | 362/362 |
| 6,530,681 | B2 | 3/2003 | Sieczkowski | 362/404 |
| D472,665 | S | 4/2003 | Herst et al. | D26/113 |
| D472,666 | S | 4/2003 | Herst et al. | D26/113 |
| D472,667 | S | 4/2003 | Herst et al. | D26/118 |
| D472,668 | S | 4/2003 | Herst et al. | D26/118 |
| D473,007 | S | 4/2003 | Herst et al. | D26/113 |
| D473,335 | S | 4/2003 | Brohard et al. | D26/113 |
| D473,672 | S | 4/2003 | Lay et al. | D26/80 |
| 6,577,136 | B1 | 6/2003 | Marques | 324/426 |
| D476,771 | S | 7/2003 | Herst et al. | D26/155 |
| D477,105 | S | 7/2003 | Herst et al. | D26/76 |
| 2001/0017775 | A1 | 8/2001 | Reinert, Sr. | |
| 2002/0044443 | A1 | 4/2002 | Kira et al. | |

OTHER PUBLICATIONS

"King Waterproof." 2001. Online Image. *King Safety Products*. Apr. 28, 2002. http://www.kingsafety.com:8080/client/kingsafety/production/data/model/view/waterproof_spec_info.html.

Precision$^2$ In-Grade Lighting: Taking Architectural Lighting to the Next Power. *B-K Lighting*. "HP$^2$ CO$^2$ MR 16 Integral Transformer." p. 5.

Lumiere Coronado 750 Series. "Coronado: Ultra-Compact Hid In-Ground Luminaires." *Copper Lighting*.

"Sure-Seal Connections: Technical Specifications". *SURE-Seal*. Catalog pp. 1-3.

HYDREL Data Sheet, 9000 Series Incandescent 75 Watt Max. In-grade Luminaire, IP67, Apr. 2000.

HYDREL Data Sheet, 9100 Series HID 175 Watt Max. In-grade Luminaire, IP67, Nov. 2000.

HYDREL Data Sheet, 9350 Series 11½" Well Lights, IP67, May 2003.

HYDREL Data Sheet, M9400 Series Fluorescent 32 Watt Max. Modular In-grade Luminaire Double Lens, IP67, Nov. 2000.

HYDREL Data Sheet, M9700 Series Fluorescent 42 Watt Max. Modular In-grade Luminaire Double Lens, IP68, Nov. 2000.

HYDREL Data Sheet, M9800 Series HID 400 Watt Max. Modular In-grade Luminaire Double Lens, IP67, Nov. 2000.

HYDREL Data Sheet, WD9000 Series Low Voltage 75 Watt Max. "Wet/Dry" Fixture, IP67, Nov. 2000.

HYDREL Data Sheet, WD9100 Series Incandescent 250 Watt Max. "Wet/Dry" Up-lights, Nov. 2000.

Kim Lighting Inc., Concept 5000 Catalog, © 1982, this version © 1993, Version Sept. 1993.

HYDREL Catalog, p. 15, Models 6322-6324 300 Watt Incandescent—240 Watt 12V Incandescent.

HYDREL, Update Letter Architectural & Landscape Catalog, Sep. 1, 1986.

HYDREL Catalog, p. 14, Models 6302 & 6312-6316 150 Watt Incandescent—100/175Watt Mercury Vapor.

Prescolite DW10/89, O-108, Low Voltage Incandescent Ground Mount Precision Uplights, Flush Guard with Convex Tempered Lens, Copyright 1989.

HYDREL Architectural & Landscape Catalog, p. 1-30.

Prescolite Catalog, Selection Index and pp. 4-10.

Prescolite DW10/89, O-115, HID Ground Mount Precision Uplights, Lexan Dome with Convex Tempered Lens, Copyright 1989.

Prescolite DW10/89, O-105, Incandescent Ground Mount Precision Uplights, Lexan Dome with Convex Tempered Lens, Copyright 1989.

HYDREL 6000 Series Architectural Lighting Catalog.

* cited by examiner

FIG. 1
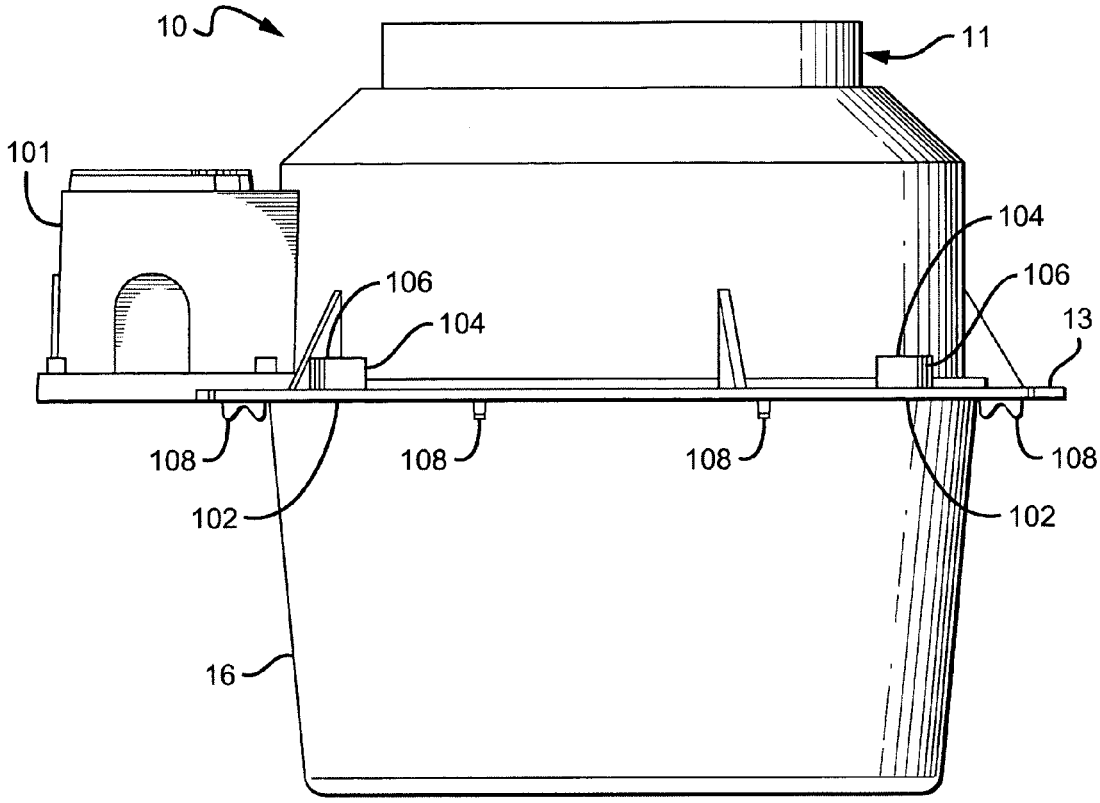
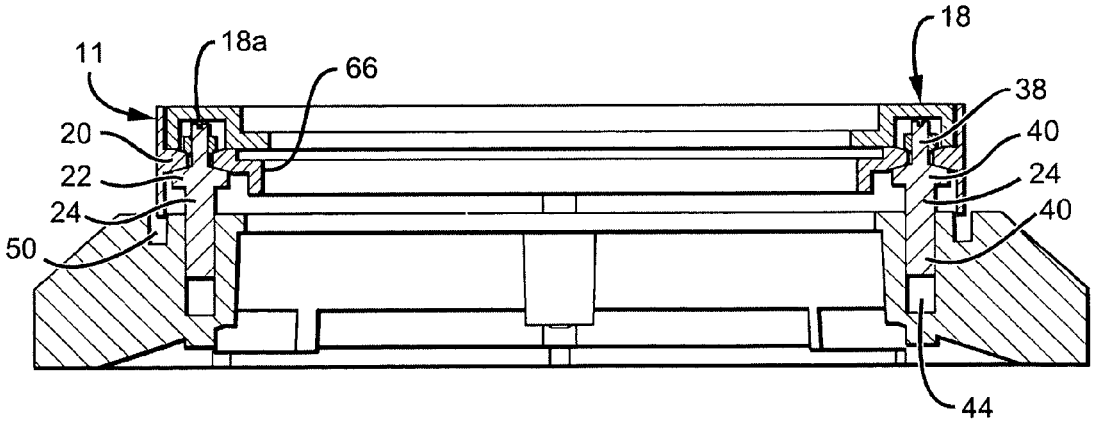
FIG. 3

IN-GRADE LIGHT FIXTURE WITH LEVELING AND ALIGNMENT MECHANISMS, INSTALLATION FEATURES AND ANTI-CONDENSATION VALVE

This application claims the benefit of U.S. Provisional Application Ser. No. 60/454,506 filed Mar. 13, 2003.

BACKGROUND OF THE INVENTION

1. Field of the Invention

This invention relates to lighting fixtures and more particularly to in-grade lighting fixtures.

2. Description of the Related Art

Conventional in-ground or in-grade lighting fixtures are typically buried all or partially below ground level and include a light emitter that illuminates up from below ground level. They can be buried in the earth or covered by hardscape such as concrete, asphalt, wood, pavers, tile, etc. The fixtures are typically used to illuminate walls, columns, flags, trees, signs or a pathway.

One type of in-grade lighting fixture generally comprises a housing and lens made of glass or other rigid and transparent material that is attached to an opening in the top of a housing. The housing contains various components including the light emitter that is arranged to emit light through the lens and electrical components that are used to power and operate the light emitter. When the light fixture is installed in-grade, the housing is typically below ground level and the lens is left uncovered so light can shine up through it. The electrical components can include a power supply, power converters, transformers, and mounting hardware for the light emitter. To hold all of these components, the housing can extend relatively deep into the ground (i.e. 14 to 16 inches).

The housing can also include a light emitter mounting system that allows pivotal rotation of the light emitter within the housing without changing the angle of the lens. This allows the lamp to be aimed in directions other than straight up. This also allows the lamp to be configured to illuminate different types of architectural features or objects by adjusting the angle of illumination.

During installation of these types of light fixtures, a hole is typically dug for the housing, the housing is placed in the hole and the hole is back filled around the housing. Any hardscape is then installed around the lens, leaving the lens uncovered. One disadvantage of these conventional light fixtures is that it can be difficult to arrange the housing in the hole so that it is level and the lens is at the proper height and angle. A misaligned or misplaced housing may not be discovered until after the hardscape has been installed. The only way to fix the arrangement of the housing is to remove the hardscape, dig out the hole around the housing and replace the housing in the hole in a better position. The hardscape can then be reinstalled.

Conventional light fixtures have faceplates that are used to hold the lens on the housing, typically with screws. Lighting fixtures are often aligned in a row and after installation, the screw holes on the faceplates can be misaligned with the screw holes in the faceplates of adjacent lighting fixtures. The misaligned screw holes can be aesthetically undesirable and there is no mechanism for adjusting the faceplate holes in conventional light fixtures to align them with adjacent holes after the fixtures have been installed.

Another disadvantage of conventional in-grade lighting fixtures is that it is difficult to properly arrange the fixtures such that the faceplate is level and at the appropriate height prior to backfilling. This can often be a trial and error process of first placing the fixture in the hole and determining if the faceplate is at the right level. If it is too high, the dirt below can be dug out and if it is too low, dirt, bricks or rocks can be placed under it. The fixture is then placed back in the hole to determine if the faceplate is in the desired location. This process is typically inaccurate, time consuming and inconvenient.

In-grade light fixtures can have an optical chamber that contains the light emitter (lamp), with the optical chamber arranged in the housing so that light from the lamp emits through an upper housing opening. One disadvantage of conventional optical chambers is that condensation can develop inside the chamber through the heating and cooling of the lamp. Also, when the lamp needs replacement or the optical chamber needs servicing, the housing faceplate is usually removed and the interior of the chamber is accessed from the above grade level. During maintenance, dirt and debris can enter the chamber from above and can result in reduced life and ineffective performance of the lamp and chamber.

SUMMARY OF THE INVENTION

The present invention seeks to provide an improved in-grade light fixture that solves the problems of conventional light fixtures. One of the features of an improved light fixture according to the invention comprises a faceplate mechanism for adjusting the level and angle of the faceplate after the light fixture hole has been backfilled and the desired hardscape has been installed. One embodiment of a faceplate mechanism according to the present invention comprises a plurality of adjustment posts arranged around an opening in the housing. The faceplate is arranged over the opening, on the adjustment posts. The height of each of the adjustment posts can be individually raised or lowered to raise and lower the faceplate, or to adjust its angle. The faceplate is also rotatable to adjust the orientation of the screw holes for their alignment with holes on adjacent light fixtures.

A lighting fixture according to the present apparatus also comprises a holding apparatus for holding the light fixture housing at the desired height and angle in a hole, prior to backfilling the hole. One embodiment of a holding apparatus according to the present invention comprises a mounting shelf around the light fixture body that has holes, each of which is sized to receive a mounting member, such as PVC pipe. Each pipe can slide within its respective hole and each of the holes has a mechanism for affixing the hole to the pipe at a desired location along its length.

The invention also provides an optical chamber anti-condensation valve that helps eliminate condensation in the optical chamber. One embodiment of a valve according to the present invention allows air to escape from the optical chamber when the pressure increases inside the chamber, but does not allow air to flow into the chamber when the inside pressure drops. Instead, when the pressure drops a vacuum is created in the chamber that does not allow the formation of condensation in the chamber. The vacuum also allows the faceplate and optical chamber to be removed from the housing as a unit so that the chamber can be serviced from above ground level. This reduces the chances that dirt and debris will be introduced into the chamber, or onto sealing surfaces.

These and other further features and advantages of the invention will be apparent to those skilled in the art from the following detailed description, taken together with the accompanying drawings, in which:

BRIEF DESCRIPTION OF THE DRAWINGS

FIG. 1 is an elevation view of one embodiment of a lighting fixture according to the present invention;

FIG. 3 is a sectional view of one embodiment of a faceplate mechanism according to the present invention;

DETAILED DESCRIPTION OF THE INVENTION

Faceplate Mechanism

Figure 2:
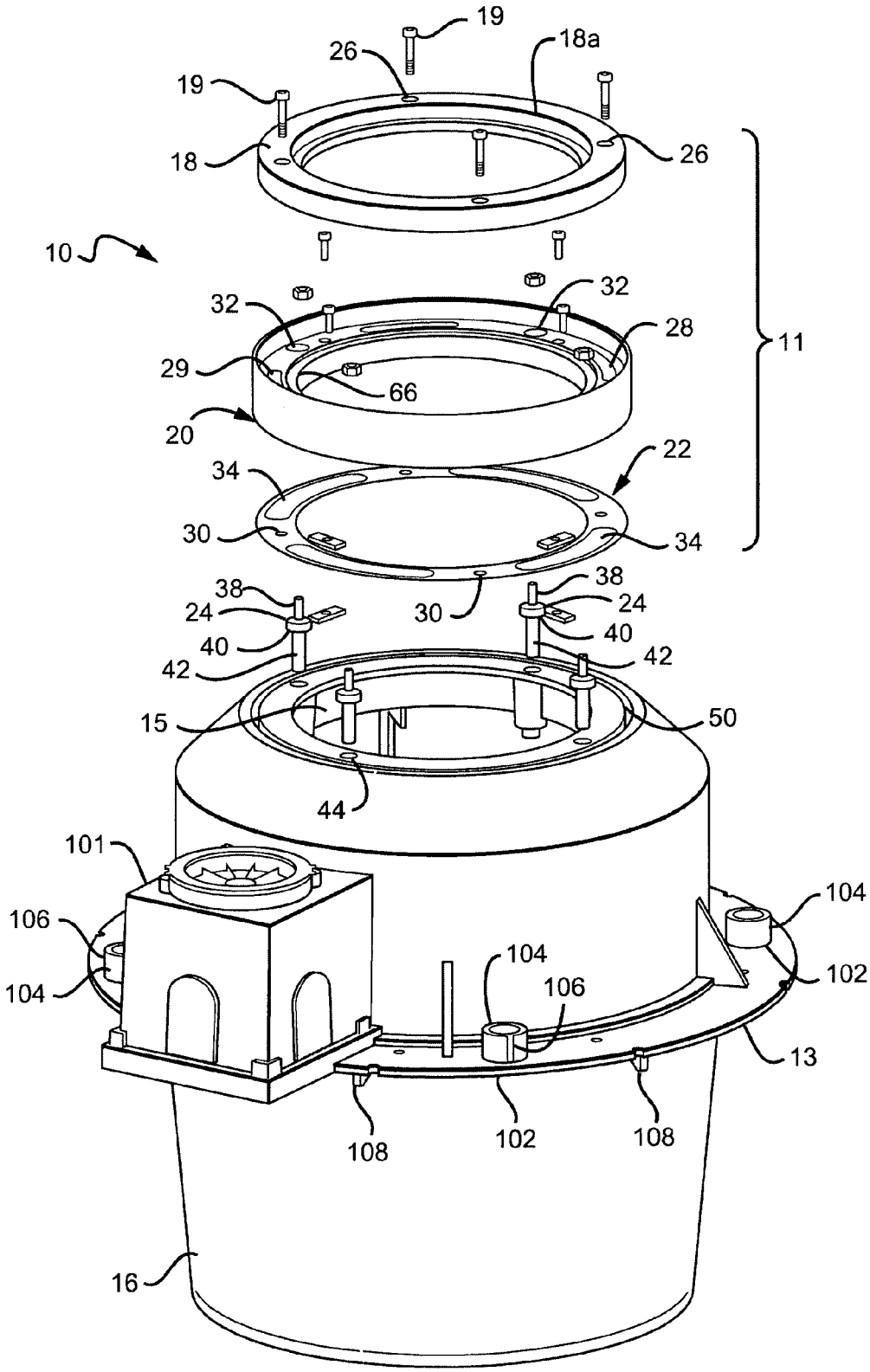
FIG. 2 is a exploded perspective view of one embodiment of a lighting fixture according to the present invention.

FIGS. 1 and 2 show one embodiment of a lighting fixture 10 according to the present invention, having a faceplate mechanism 11 and a mounting shelf 13. The faceplate mechanism 11 is sized to mount over the top circular opening 15 in the light fixture housing 16 and allows the height and angle of a faceplate 18 to be adjusted to compensate for any misalignment between the faceplate 18 and the surrounding finished surface of the ground and/or hardscape. The faceplate mechanism 11 also allows for adjustment of the faceplate screw holes 26 so that they can be aligned with the screw holes of adjacent lighting fixtures. The mounting shelf 13 allows the housing 16 of the lighting fixture 10 to be more easily and accurately arranged within a hole before backfilling to reduce the chances of misalignment during installation.

Referring to FIGS. 2 and 3, the faceplate mechanism 11 generally comprises a faceplate 18, leveling collar 20, nut ring 22, mounting screws (not shown), and adjustment posts 24. When the faceplate mechanism 11 is assembled, the leveling collar 20 is held onto the adjustment posts 24 by the jam nuts. The faceplate 18 comprises a circular faceplate casting 18*a* that holds a circular lens (not shown) within it, with an airtight and watertight seal between the casting 18*a* and the lens. The faceplate 18 can be different sizes and the faceplate casting 18*a* can be made of different materials such as cast 360 aluminum, brass, or stainless steel, all of which can be painted different colors. The lens can be made of any rigid and transparent material such as tempered borosilicate glass, and should be thick enough to withstand the weight that may be placed on it, for example, by foot or vehicle traffic.

The faceplate 18 has four equally spaced faceplate holes 26, although in other embodiments more or less holes can also be used. Each of the holes 26 aligns with one of four collar slots 28, and also aligns with one of four nut ring holes 30. Each mounting screw is inserted into a respective one of the four faceplate holes 26 and each screw passes through a respective aligned collar slot 28. Each of the nut ring holes 30 can be threaded to mate with the threads on the mounting screws. In alternative nut ring embodiments, such as shown in FIG. 1, the nut ring 22 may be too thin to be effectively threaded and alternative mechanisms are needed to provide the threads to mate with the mounting screws. One of these alternative mechanisms is a cage nut that is mounted in the square nut ring holes. Other mechanisms include a pem nut or avdel nut, each of which can be inserted into a respective nut ring hole 30.

The nut ring can be made of different materials, with a suitable material being stainless steel. The leveling collar can be made of the same materials as the faceplate. The faceplate 18, leveling collar 20 and nut ring 22 can have different diameters depending on the size of the housing opening 15, with a suitable diameter for each being approximately, 10¾, 11¼ and 11 inches respectively.

When each of the mounting screws is inserted into the aligned faceplate hole 26 and collar slot 28, and tightened in a respective nut hole 30, the leveling collar 20 is held firmly between the nut ring 22 and the faceplate 18. Different types of mounting screws can be used with the preferred screws being captive screws, which are known in the art. The head of each captive screw is retained within its faceplate hole 26 when the screws are unscrewed from the nut ring holes 30. This prevents the screws from falling out of the faceplate holes during maintenance of the light fixture 10.

The leveling collar 20 has four collar holes 32 each of which aligns with one of four nut ring slots 34, although more or less holes 32 and slots 34 can also be used. Each of the four adjustment posts 24 has a threaded top section 38, a wider section 40 and a threaded lower section 42. Each lower section 42 is threaded to mate with one of four threaded post holes 44 that are equally spaced around the housing's top circular opening 15. The post holes 44 are aligned with the collar holes 32 and when the posts 24 are mounted in the post holes 44, the top section 38 of each post 24 passes through its respective collar hole 32. Each top section has an upper slot that allows each of the posts 24 to be turned using a screwdriver when the leveling collar 20 is in place over the posts 24.

Each wider section 40 is rounded slightly on top and the bottom surface of each collar hole 32 is also rounded to match the wider section's top surface. When the leveling collar is in place, it rests on the wider sections 40 with the only contact between the leveling collar and the remainder of the fixture 10 below is its contact with the posts 24. Each of the wider sections 40 also fits closely within one of the four nut ring slots 34. When the mounting screws are turned into the nut ring holes 30 to mount the faceplate 18 (as described above), the nut ring 22 is arranged in a slot 28 in the bottom of the leveling collar 20 (as best shown in FIG. 3).

A circular clearance cavity 50 is included around the housing opening 15, outside the post holes 44, and is arranged so that the lower portion of the adjustment collar 20 can pass into the cavity 50 when the collar 20 is lowered on the posts 24. The cavity 50 gives additional range to the lowering of the collar 20 by allowing the lower portion of the collar 20 to pass below the upper surface of the housing 16. Different ranges of adjustment can be provided for the faceplate mechanism 11, with a typical range being ¼ of an inch up and down from a medium position.

In operation, each of the adjustment posts 24 is mounted in a respective one of the four post holes 44, and the adjusting collar and attached nut ring is placed over posts 24. The leveling collar 20 is then placed on the adjustment posts 24, with the upper section 38 of each post passing through a respective collar hole 32 and the collar resting on the wider sections 40 of the posts 24. The fixture 10 is then placed in a hole, the hole is backfilled, and any desired hardscape is installed.

The protective cover can then be removed to allow an optical chamber to be installed as more fully described below. However, before installing the optical chamber, the height and angle of the leveling collar 20 can be adjusted to match the level of the surrounding grade or hardscape by turning the desired posts 24. The posts 24 can be turned while the collar 20 is in place by a screwdriver turning the post upper portions 38 that extend through the collar holes 32. If the level of the collar 20 is to be lowered, the posts 24 are turned further into the post holes 44. If the level is to be raised, the posts 24 are turned out of the post holes 44 so that they extend further from the holes. To adjust the angle of the collar, the height of fewer than all of the posts 24 can be adjusted appropriately. When the collar 20 is in its desired position, it can be locked in place by locking jam nuts that can be turned and tightened on the threaded upper section 38 so that part of the collar 20 is sandwiched between each of the nuts and its respective post upper section 40.

Figure 4:
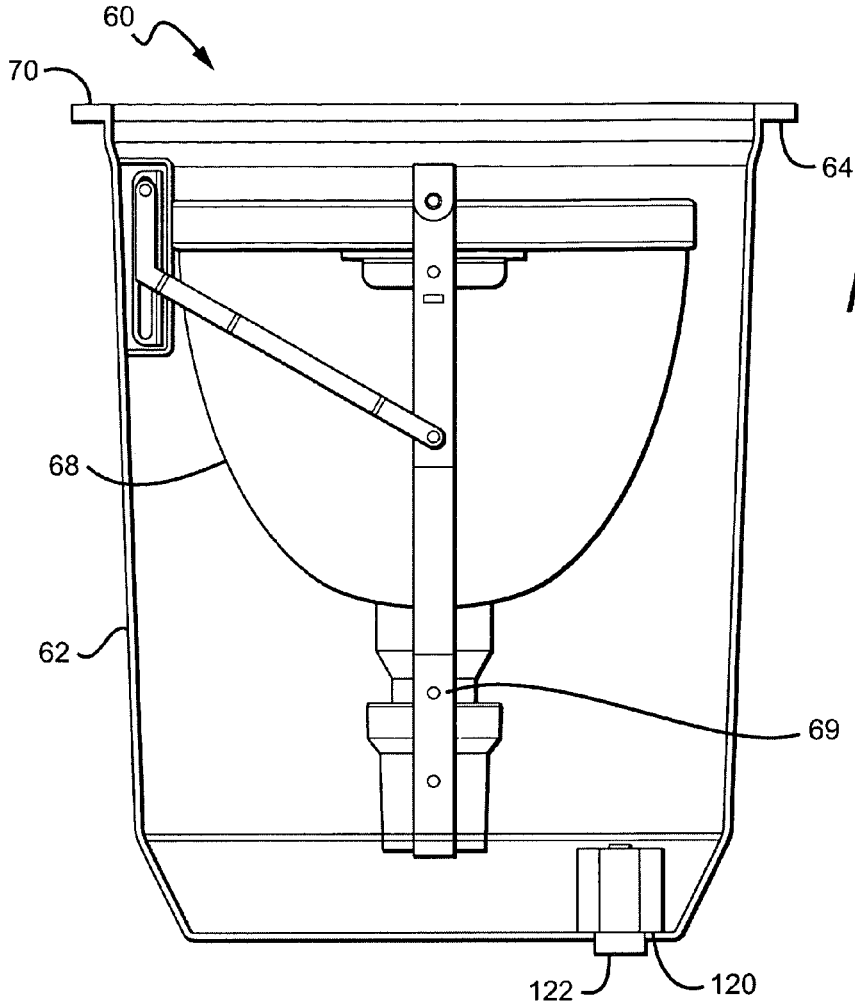
FIG. 4 is an elevation view of one embodiment of an optical chamber according to the present invention.
Figure 5:
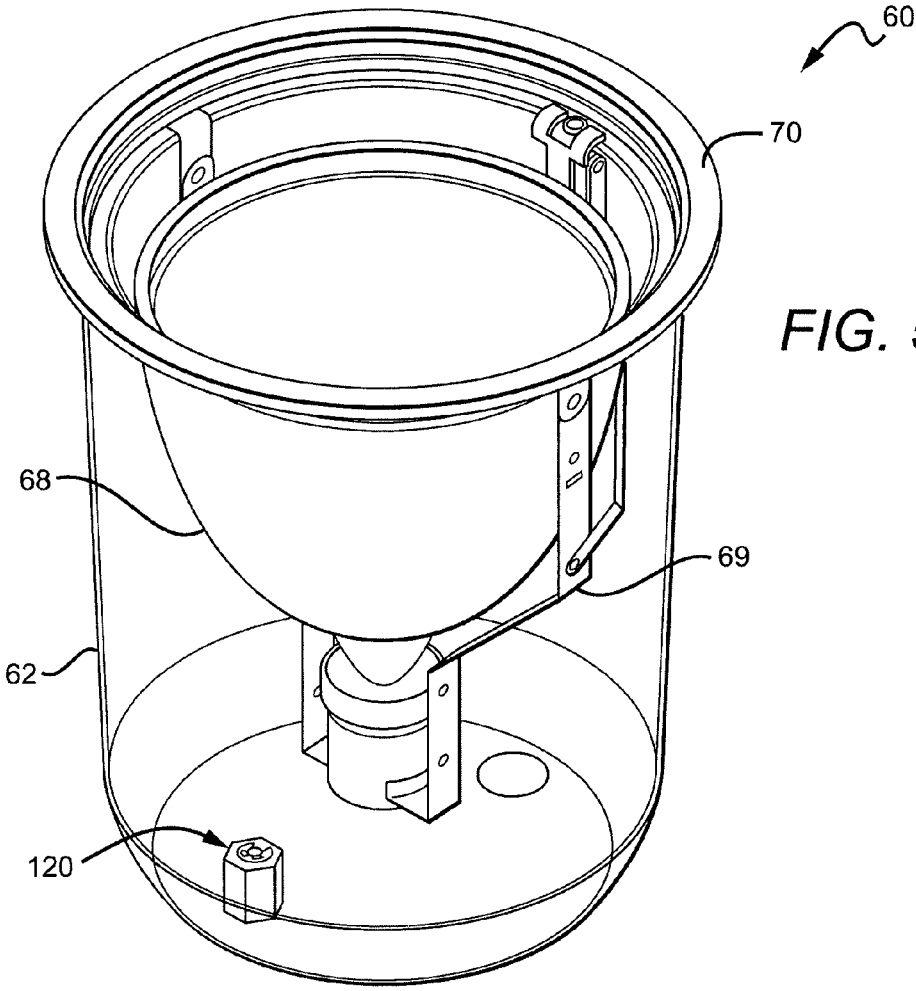
FIG. 5 is a perspective view of the optical chamber in FIG. 4.

FIGS. 4 and 5 show one embodiment of optical chamber 60 according to the present invention that can be installed in the housing 16 after the collar 20 is properly adjusted. The body 62 is sized to fit through the collar 20, nut ring 22 and housing opening 15, and has a flange 64 that rests on an inside ledge 66 on the collar 22 (shown in FIGS. 2 and 3). The optical chamber 60 is arranged inside the housing 16 with the light emitter (lamp) 68 directed up. Other optical chambers according to the present invention can house different types of emitters, including but not limited to light emitting diodes, lasers, fluorescent lights, etc., each of which can be arranged in many different ways within the chamber. The optical chamber 60 also comprises a mounting system 69 that allows the lamp 68 to pivot to adjust the direction of lamp illumination without changing the position or angle of the faceplate 18 or collar 20. A circular silicon gasket 70 is positioned on the top outside diameter, and bottom surfaces of the flange 64 and the faceplate 20 is placed on the collar 20. When the mounting screws are tightened into the nut ring holes 30 the faceplate casting 18*a* compresses the gasket 70 providing an airtight and watertight seal between the faceplate 20 and flange 64.

When a plurality of light fixtures 10 are installed in a row, it is aesthetically important for the faceplate holes 26 in one fixture 10 to align with the holes in adjacent installed fixtures 10. To make this adjustment, after the fixtures 10 have been installed, the mounting screws can be partially loosened in the faceplate holes 26 with the mounting screws still threaded in their respective nut ring holes 30. The faceplate 18 and nut ring 22 remain connected together by the mounting screws and can be rotated as a unit. The leveling collar 20, however, is held in place by the adjustment posts 24. The faceplate 18 and nut ring 22 combination can be rotated left or right to adjust the orientation of the faceplate holes 26. During this rotation, the mounting screws slide within the stationary collar slots 28 and the stationary mounting posts 24 slide within the rotating nut ring slots 34. The amount of the faceplate rotational adjustment is limited by the length of the collar slots 28 and nut ring slots 34. After the faceplate holes 26 have been aligned with the holes in adjacent lighting fixtures 10, the mounting screws can be tightened to hold the faceplate 18 and nut ring 22 in position.

Mounting Shelf

Referring again to FIGS. 1 and 2, the housing 16 also has an axial mounting shelf 13 located above the housing's mid-section that is used for conveniently and accurately mounting the lighting fixture 10 in a hole so that it is level and at the appropriate height. The shelf 13 is generally horizontal and has four equally spaced holes 102, with each hole having one of four upwardly extending hole sleeves 104. The shelf 13 extends around nearly the entire housing 16, with its only interruption being a splicing compartment 101 that is arranged for splicing incoming power to the lighting fixture lamp.

The holes 102 and sleeves 104 have the same diameter and are sized to accept an elongated stilts 105, such as standard PVC pipe. Alternative holes and sleeves can have different diameters to accept different sizes of PVC pipe or different elongated stilts, and the hole and sleeve cross-section can have different shapes such as square, rectangle, oval, etc.

The PVC pipe can be mounted within each of the holes using many different mounting methods, including but not limited to gluing, welding, clamping or crimping. In a preferred mounting method each pipe is held in the sleeve 104 by a sleeve mounting screw. Each sleeve 104 has longitudinal crease 106 on its outside surface for a screw to turn into the sleeve 104 and fix the sleeve 104 to PVC pipe inserted therein. The crease 106 is designed to accept a standard "TEK screw", although other screws can also be used. The screw can be turned partially through a respective sleeve 106 at the crease, which causes the sleeve 104 to bulge toward and hold the PVC pipe. Alternatively, the screw can be turned through the sleeve 104 and into the PVC pipe to hold it in place.

In one method of using the mounting shelf 13 and PVC pipe according to the invention, the light fixture 10 is placed in a hole. Separate pieces of PVC pipe are then inserted into the holes 102 and sleeves, with each of the pipes being long enough that their lower end rests on the surface of the ground at the base of the housing 16 and their upper end extends through and above the top of its respective sleeve 104. The lower end of each of the PVC pipes is then forced into the ground, preferably by hammering on each pipe's upper end. The pipes should be pounded in far enough so that they can support the weight of the lighting fixture 10. The lighting fixture can then be slid up and down on the PVC pipes until it is at the desired height and angle. Tech screws can then be inserted into the sleeve creases to hold the light fixture 10 at its location so that the light fixture 10 is then held above the ground on the PVC pipes. The hole can then be backfilled and leveled around the protective cover and any desired hardscape can be installed.

The bottom surface of the shelf 13 also comprises rebar clips 108 that are arranged to rest on rebar in those installations where rebar is used to reinforce the hardscape. When the clips are placed on the rebar, a tie wire can be fed through the rebar hole 109 adjacent to the clip, wrapped around the rebar, and fed back through the rebar notch 110. The ends of the tie can then be knotted together to hold the sleeve 13 to the rebar. This clip and tie arrangement holds the fixture in place during installation of the hardscape. The angle and level of the faceplate 18 can then be adjusted as described above.

Chamber Valve

Referring to FIGS. 4 and 5, the optical chamber 60, as described above further comprises a valve 120 arranged at the bottom of the body 62, although the valve may be arranged in other locations. The valve 120 is designed and positioned to allow air to pass out of the body when pressure builds up in the chamber 60, and to block ambient air from passing back into the chamber 62.

When the chamber 60 is installed in the housing 16 and the faceplate mechanism 12 is mounted in place, a seal is created between the faceplate 18 and the flange 64. The chamber 60 is sealed from the ambient and the only way for air to pass out of the chamber 60 is through the valve 120. During operation of the lamp 68, air within the chamber is heated, which causes the air to expand and air pressure to build within the chamber 60. As the pressure builds, air passes out of the valve 120. When the lamp 68 is not operating, the air within the chamber 68 cools, but no air is allowed to pass back into the chamber 62 through the valve 120. This results in the formation of a negative air pressure, or vacuum, within the chamber 62. This negative air pressure has the benefit of preventing condensation within the chamber.

This negative air pressure provides an additional benefit during the maintenance of the light fixture 10. When replacing the lamp 68 or conducting other maintenance on the chamber 62, the interior of the chamber must be accessible. As described above, in conventional light fixtures, the faceplate is removed and the interior of the chamber is accessed from above, which presents a danger that dirt or other debris can enter the chamber.

The negative air pressure (approximately 160 pounds) in the chamber 60 results in the faceplate 18 being held to the flange 64 such that the faceplate 10 and chamber 60 form a single unit. Accordingly, as the faceplate 18 is removed from the housing 16, the chamber 60 is removed with it. To remove the faceplate 18 from the chamber 60, the chamber's negative air pressure can be reduced by pressing the air release button 122 that extends from the bottom of the valve 120. This allows air to flow back into the chamber to reduce the pressure until the faceplate 18 can be easily removed.

By removing the faceplate 18 and chamber 60 as a unit, the lamp replacement (or other maintenance) can be conducted above ground level where there is a reduced chance that dirt or other debris would enter the chamber 60. When conducting maintenance on a plurality of light fixtures, each of the faceplate 18 and chamber 60 units can be removed and taken to a clean work area for maintenance. This would further reduce the chance for dirt or debris to enter the chamber 60.

Figure 6:
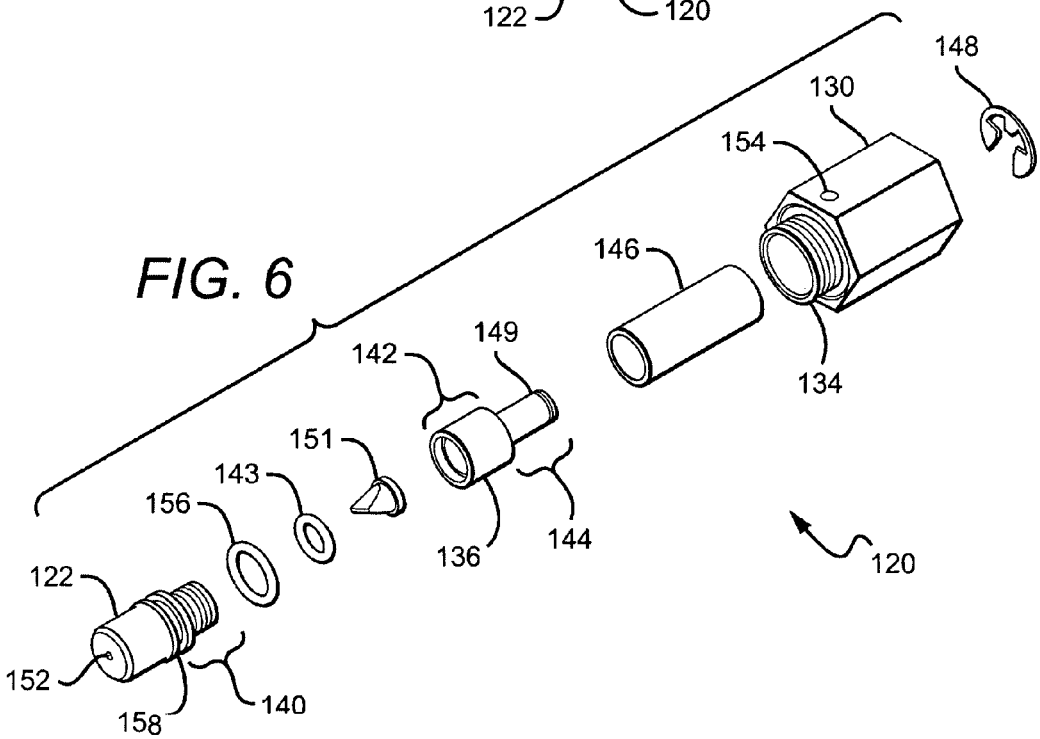
FIG. 6 is an exploded perspective view of one embodiment of the patented chamber valve according to the present invention.
Figure 7:
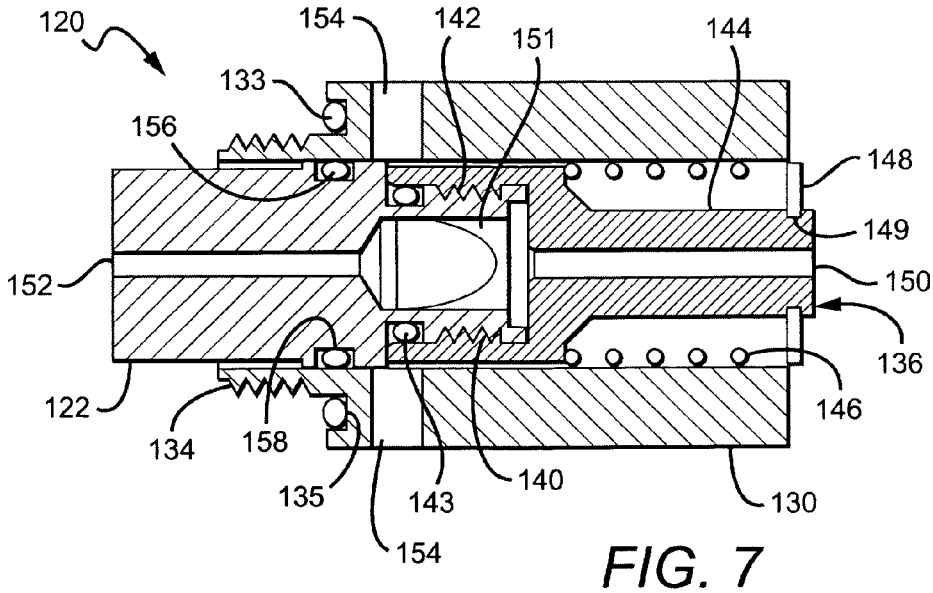
FIG. 7 is a sectional view of the patented chamber valve of FIG. 6.

FIGS. 6 and 7 show the valve 120 in more detail, which comprises a housing 130 that has mounting threads on its lower/narrower section 134. The lower section 134 is inserted into a hole at the bottom of the chamber 60 with the housing primarily within the chamber 60 and the lower section 134 extending from the bottom of the chamber 60. A nut (not shown) is mounted to the portion of the lower section 134 that extends from the chamber 60 and is tightened to mount the housing 130 in place. An O-ring 133 is mounted to a housing O-ring groove 135 to provide an air and watertight seal between the housing 130 and chamber 60.

A spool 136 and the button 122 are arranged within a longitudinal cavity in the housing 130. A narrow button section 140 is threaded to mate with the threads on the inside of the wider spool section 142. An O-ring 143 is provided between the two to provide an airtight seal. When installed, the spool 136 and button 122 operate as a single unit. The narrow spool section 144 extends from the housing 134 and a spring 146 is included that biases the spool 136 toward the bottom of the chamber 60. The spool 136 is prevented from fully extending into the housing 134 by an E-ring 148 that is mounted in an axial groove 149 at the end of the spool 136.

The spool 136 and the button 122 each have a passageway 150, 152 down their longitudinal axis, that align down the housing's longitudinal axis when the spool 136 and button 122 are mounted together as a unit in the housing 130. The aligned passageways 150, 152 allow air to pass freely between the chamber and the ambient outside the chamber 60. However, a duckbill valve 151 is arranged within the button's narrow section 140 between the aligned passageways 150, 152 so that air passing from the chamber 60 passes through the duckbill valve 151. The duckbill valve has a slit 153 that remains closed unless there is positive pressure from within the chamber 60. The positive pressure passes through passageway 150, and into the duckbill valve 151 causing the slit 153 to open and the positive pressure to dissipate to the ambient through passageway 152. This pressure dissipation occurs during operation of the lamp 68, when pressure builds within the chamber. However, after operation of the lamp stops and the chamber is cooled, a vacuum is created in the chamber by the duckbill valve 151 preventing the higher pressure ambient air from passing into the chamber 60.

When removing the faceplate 18 from the chamber 60, the vacuum is released by pressing the button 122 as described above. This action causes the button 122 and spool 136 to slide within the housing cavity against the bias of the spring 146. Air ports 154 are included in the housing 130 to provide air passageways from the interior of the chamber into the cavity of the housing 130. During normal operation, the passageway is blocked from the ambient by the spool 136, button 122, and a button O-ring 156 that is mounted in a button O-ring groove 158 to provide a seal between the button 138 and the surface of the housing cavity. However, as the spool 136 and button 122 slide toward the interior of the chamber, the O-ring 156 passes the air ports 154, which allows air to flow into the chamber through the spacing 160 between the button 138 and the interior of the housing cavity and into the air ports 154. This allows for air to enter the chamber to reduce/eliminate the vacuum.

When the button 138 is released, the bias of the spring 146 causes the spool/spring combination to slide back to its position as shown in FIG. 7. In this position the only path for air to leave the chamber is though the slit in the duckbill valve.

Although the present invention has been described in considerable detail with reference to certain preferred configurations thereof, other versions are possible. Therefore, the spirit and scope of the invention should not be limited to the preferred versions in the specification.

We claim:

1. An in-grade light fixture, comprising:

a light fixture housing arranged to be buried substantially below grade level, said light fixture housing having a light opening substantially at grade level;

a light source arranged within said light fixture housing and generating light that passes through said light opening;

a faceplate mechanism mounted over said light opening; and an adjustment mechanism to allow the height and angle of said faceplate mechanism to be adjusted over said light opening to match the height and angle of the surrounding grade level and angle wherein said adjustment mechanism comprises a plurality of mounting posts on said light fixture housing, said faceplate mechanism arranged on said mounting posts.

2. The light fixture of claim 1, wherein said faceplate mechanism comprises a lens, said light from said light sources passing through said lens.

3. The light fixture of claim 2, wherein said lens is arranged to support the weight of foot or vehicle traffic without failing.

4. The light fixture of claim 2, wherein said lens is made of tempered borosilicate glass.

5. The light fixture of claim 1, wherein, the height of each of said mounting posts is adjustable to adjust the height and angle of said faceplate mechanism.

6. The light fixture of claim 5, further comprising a plurality of threaded post holes, each of said plurality of mounting posts having a threaded section to mate with a respective one of said threaded post holes, the turning of each of said mounting posts within its respective post hole adjusting the height of said post.

7. The light fixture of claim 5, further comprising a leveling collar resting on said mounting posts, with said faceplate mechanism resting on said leveling collar, adjusting the height of said mounting posts causing the height of said leveling collar to adjust.

8. The light fixture of claim 7, further comprising an optical chamber resting on said leveling collar with substantially all of said chamber within said light fixture housing, said light source arranged within said optical chamber.

9. An in-grade light fixture, comprising:

a light fixture housing arranged to be buried substantially below grade level, said light fixture housing having a light opening substantially at grade level;

a light source arranged within said light fixture housing and generating light that passes through said light opening;

a faceplate mechanism arranged over said light opening and held in place by mounting screws, said faceplate mechanism being at least partially rotatable over said light opening such that the location of said mounting screws can be adjusted around said light opening, said faceplate mechanism being adjustable over said light opening with adjustable mounting posts to match the height and angle of the surrounding grade level and angle.

10. The light fixture of claim 9, wherein said mounting screws pass through said faceplate mechanism such that the top of said screws are visible.

11. The light fixture of claim 10, wherein said faceplate mechanism comprises a lens, said light from said light sources passing through said lens.

12. The light fixture of claim 11, wherein said lens is arranged to support the weight of foot or vehicle traffic without failing.

13. The light fixture of claim 11, wherein said lens is made of tempered borosilicate glass.

14. The light fixture of claim 9, wherein said light opening its circular and said faceplate mechanism is at least partially rotatable over said light opening such that the location of said mounting screws can be adjusted around the circumference of said light opening.

15. The light fixture of claim 9, wherein said light fixture housing is buried in proximity to another similar one of said light fixture housing, said mounting screws being adjustable around said light opening to align with mounting screws in said other light fixture housing.

16. The light fixture of claim 9, further comprising a faceplate having a plurality of faceplate holes, a nut ring having a plurality of nut ring holes and a leveling collar having a plurality of collar slots, said leveling collar arranged between said nut ring and faceplate, each of said mounting screws passing through a respective one of said faceplate holes, a respective one of said collar slots, and threaded into a respective one of said nut ring holes, said leveling collar in a fixed position over said light opening, the location of said mounting screws being adjusted by rotating said faceplate and said mounting screws sliding within said collar slots.

17. An in-grade light fixture, comprising:

a light fixture housing arranged to be buried substantially below grade level, said light fixture housing having a light opening substantially at grade level;

an optical chamber arranged within said light fixture housing, said chamber holding a light source generating light that passes through said light opening;

a faceplate mechanism mounted over said light opening and to said optical chamber and held in place by mounting screws, said faceplate mechanism being at least partially rotatable over said light opening such that the location of said mounting screws can be adjusted around said light opening;

an adjustment mechanism to allow the height and angle of said faceplate mechanism to be adjusted over said light opening with adjustable mounting posts to match the height and angle of the surrounding grade level and angle;

a holding mechanism for holding said light fixture housing at the desired height within a hole prior to being buried; and an anti-condensation valve on said optical chamber that allows air to escape from the optical chamber when the pressure increases inside the chamber, but does not allow air to flow into the chamber when the inside pressure drops, said chamber being otherwise airtight and having an airtight connection to said faceplate mechanism, said optical chamber forming a vacuum when the inside temperature drops, thereby reducing the formation of condensation in said optical chamber.

* * * * *